US007407082B2

(12) United States Patent
Chun et al.

(10) Patent No.: US 7,407,082 B2
(45) Date of Patent: Aug. 5, 2008

(54) ADVANCED EROSION RESISTANT CARBONITRIDE CERMETS

(75) Inventors: ChangMin Chun, Belle Mead, NJ (US); Narasimha-Rao Venkata Bangaru, Annandale, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 96 days.

(21) Appl. No.: 11/348,598

(22) Filed: Feb. 7, 2006

(65) Prior Publication Data

US 2006/0156862 A1 Jul. 20, 2006

Related U.S. Application Data

(62) Division of application No. 10/829,820, filed on Apr. 22, 2004.

(60) Provisional application No. 60/471,994, filed on May 20, 2003.

(51) Int. Cl.
*B23K 26/20* (2006.01)
*B22F 7/04* (2006.01)

(52) U.S. Cl. ..... 228/115; 419/5; 419/8

(58) Field of Classification Search ..... 419/5, 419/8, 9; 427/181, 451, 189, 191; 228/115; 428/941

See application file for complete search history.

(56) References Cited

U.S. PATENT DOCUMENTS 4,671,932 A * 6/1987 Lutz et al. ..... 420/452
4,681,734 A * 7/1987 Simm et al. ..... 419/9
4,822,689 A * 4/1989 Fukubayashi et al. ..... 428/472
5,079,100 A * 1/1992 Descamp et al. ..... 428/552
6,162,276 A * 12/2000 Berger et al. ..... 75/252

FOREIGN PATENT DOCUMENTS

JP 1998195585 A 8/1998

* cited by examiner

*Primary Examiner*—Roy King
*Assistant Examiner*—Ngoclan T. Mai
(74) *Attorney, Agent, or Firm*—Robert A. Migliorini; Ramesh Varadaraj

(57) ABSTRACT

The invention includes a cermet composition represented by the formula (PQ)(RS) comprising: a ceramic phase (PQ) and a binder phase (RS) wherein, P is a metal selected from the group consisting of Ti, Zr, Hf, V, Nb, Ta, Cr, Mo, W, Fe, Mn and mixtures thereof, Q is carbonitride, R is a metal selected from the group consisting of Fe, Ni, Co, Mn and mixtures thereof, S comprises at least one element selected from Cr, Al, Si and Y.

25 Claims, 5 Drawing Sheets

ADVANCED EROSION RESISTANT CARBONITRIDE CERMETS

This application is a divisional application filed under 37 C.F.R. 1.53(b) of parent application Ser. No. U.S. 10/829,820, filed Apr. 22, 2004, the entirety of which is hereby incorporated herein by reference, which claims the benefit of U.S. Provisional application 60/471,994 filed May 20, 2003.

FIELD OF INVENTION

The present invention is broadly concerned with cermets, particularly cermet compositions comprising a metal carbonitride. These cermets are suitable for high temperature applications wherein materials with superior erosion and corrosion resistance are required.

BACKGROUND OF INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials is chemically bonded castable alumina refractories. These castable alumina refractories are applied to the surfaces in need of protection and upon heat curing hardens and adheres to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Therefore there is a need for materials with superior erosion and corrosion resistance properties for high temperature applications. The cermet compositions of the instant invention satisfy this need.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

The present invention includes new and improved cermet compositions.

The present invention also includes cermet compositions suitable for use at high temperatures.

Furthermore, the present invention includes an improved method for protecting metal surfaces against erosion and corrosion under high temperature conditions.

These and other objects will become apparent from the detailed description which follows.

SUMMARY OF INVENTION

The invention includes a cermet composition represented by the formula (PQ)(RS) comprising: a ceramic phase (PQ) and a binder phase (RS) wherein, P is a metal selected from the group consisting of Ti, Zr, Hf, V, Nb, Ta, Cr, Mo, W, Fe, Mn and mixtures thereof, Q is carbonitride, R is a metal selected from the group consisting of Fe, Ni, Co, Mn and mixtures thereof, S comprises at least one element selected from Cr, Al, Si and Y.

DETAILED DESCRIPTION OF THE INVENTION

Figure 1:
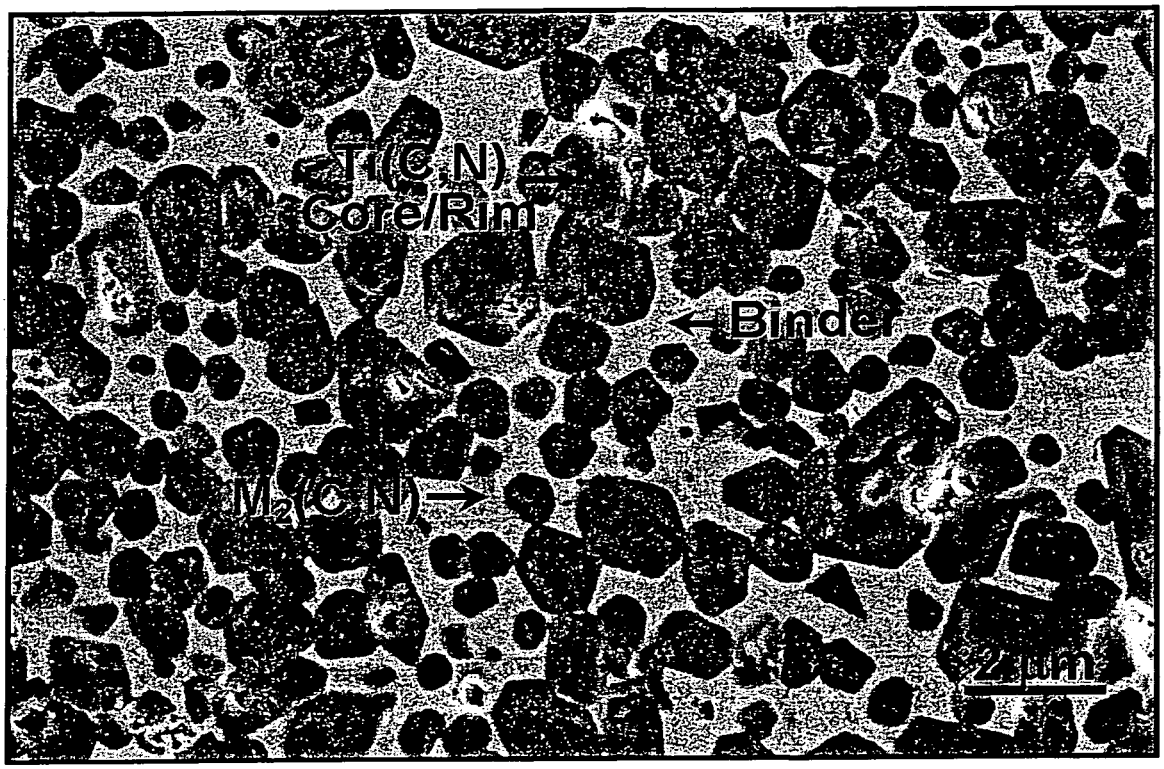
FIG. 1 is a scanning electron microscope (SEM) image of $TiC_{0.7}N_{0.3}$ cermet made using 30 vol % 304 stainless steel (304SS) binder illustrating the Ti(C,N) ceramic phase particles dispersed in binder and the reprecipitation of new phase $M_2$(C,N) where M is mainly Cr, Fe, and Ti and M(C,N) carbonitride where M is mainly Ti and Ta. Also shown in the micrograph is the formation of M(C,N) rim around the Ti(C,N) ceramic.

One component of the cermet composition represented by the formula (PQ)(RS) is the ceramic phase denoted as (PQ). In the ceramic phase (PQ), P is a metal selected from the group consisting of Ti, Zr, Hf, V, Nb, Ta, Cr, Mo, W, Fe, Mn and mixtures thereof. Q is carbonitride. Thus the ceramic phase (PQ) in the carbonitride cermet composition is a metal carbonitride. The molar ratio of P to Q in (PQ) can vary in the range of 1:3 to 3:1. Preferably in the range of 1:2 to 2:1. As non-limiting illustrative examples, when P=Ti, (PQ) can be Ti(C,N) wherein P:Q is 1:1. When P=Cr then (PQ) can be $Cr_2$(C,N) wherein P:Q is 2:1. The ceramic phase imparts hardness to the carbonitride cermet and erosion resistance at temperatures up to about 1000° C.

The ceramic phase (PQ) of the cermet is preferably dispersed in the binder phase (RS). It is preferred that the size of the dispersed ceramic particles is in the range 0.5 to 3000 microns in diameter. More preferably in the range 0.5 to 100 microns in diameter. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes. In another embodiment of this invention, the ceramic phase (PQ) is dispersed as platelets with a given aspect ratio, i.e., the ratio of length to thickness of the platelet. The ratio of length:thickness can vary in the range of 5:1 to 20:1. Platelet microstructure imparts superior mechanical properties through efficient transfer of load from the binder phase (RS) to the ceramic phase (PQ) during erosion processes.

Another component of the carbonitride cermet composition represented by the formula (PQ)(RS) is the binder phase denoted as (RS). In the binder phase (RS), R is the base metal selected from the group consisting of Fe, Ni, Co, Mn and mixtures thereof. S is an alloying metal comprising at least one element selected from Cr, Al, Si and Y. S can further comprise an aliovalent element selected form the group consisting of Y, Ti, Zr, Hf, Ta, V, Nb, Cr, Mo, W and mixtures thereof. The combination weight of Cr, Al, Si, Y and mixtures thereof are of at least about 12 wt % based on the weight of the binder (RS). The aliovalent element is about 0.01 wt % to about 5 wt %, preferably about 0.01 wt % to about 2 wt % of based on the weight of the binder. The elements Ti, Zr, Hf, Ta, V, Nb, Cr, Mo, W are aliovalent elements characterized by multivalent states when in an oxidized state. These elements decrease defect transport in the oxide scale thereby providing enhanced corrosion resistance.

In the carbonitride cermet composition the binder phase (RS) is in the range of 5 to 50 vol %, and preferably 5 to 30 vol %, based on the volume of the cermet. The mass ratio of R to S can vary in the range from 50/50 to 90/10. In one preferred embodiment the chromium content in the binder phase (RS) is at least 12 wt % based on the weight of the binder (RS). In another preferred embodiment the combined zirconium and hafnium content in the binder phase (RS) is about 0.01 wt % to about 2.0 wt % based on the total weight of the binder phase (RS).

The cermet composition can further comprise secondary carbonitrides (P'Q) wherein P' is selected from Ti, Zr, Hf, V, Nb, Ta, Cr, Mo, W, Fe, Ni, Co, Mn, Al, Si, Y and mixtures thereof. Stated differently, the secondary carbonitrides are derived from the metal elements from P, R, S and combinations thereof of the cermet composition (PQ)(RS). The ratio of P' to Q in (P'Q) can vary in the range of 3:1 to 1:3. The total ceramic phase volume in the cermet of the instant invention includes both (PQ) and the secondary carbonitrides (P'Q). In the carbonitride cermet composition (PQ)+(P'Q) ranges from of about 50 to 95 vol % based on the volume of the cermet. Preferably from 70 to 95 vol % based on the volume of the cermet.

The volume percent of cermet phase (and cermet components) excludes pore volume due to porosity. The cermet can be characterized by a porosity in the range of 0.1 to 15 vol %. Preferably, the volume of porosity is 0.1 to less than 10% of the volume of the cermet. The pores comprising the porosity is preferably not connected but distributed in the cermet body as discrete pores. The mean pore size is preferably the same or less than the mean particle size of the ceramic phase (PQ).

One aspect of the invention is the micro-morphology of the cermet. The ceramic phase can be dispersed as spherical, ellipsoidal, polyhedral, distorted spherical, distorted ellipsoidal and distorted polyhedral shaped particles or platelets. The cermet may also include layered structure having a core carbonitride surrounded by a layer of secondary carbonitride. Preferably, at least 50% of the dispersed particles is such that the particle-particle spacing between the individual carbonitride ceramic particles is at least 1 nm. The particle-particle spacing may be determined for example by microscopy methods such as SEM and TEM.

In crystalline solids such as metals and ceramics, the individual atoms or ions are arranged in such as way that they display three dimensional periodicity in arrays described as crystal lattice. Ceramic phases such as metal carbides and metal nitrides are crystalline solids with inter-penetrating metal atom and non-metal atom sublattices, respectively. For instance, in the case of TiC ceramic phase, there are two sublattices, one of Ti metal and the other of C non-metal wherein the interchange of lattice positions of Ti and C is not allowed. However, in many carbides and nitrides, carbon or nitrogen can substitute readily for each other on the non-metal sublattice for the whole range of possible chemistries, that is, pure carbide to pure nitride. Thus, in these cases there is complete mutual solubility wherein carbide and nitride of the same metal dissolve in each other through the entire range from pure carbide to pure nitride. For instance, TiC and TiN can dissolve in each other producing mixed carbide-nitride, commonly referred to as a carbonitride phase, and denoted by Ti(C,N). In this case, carbon and nitrogen freely substitute for each other in either carbon atom or nitrogen atom sublattice. However, the ratio of total metal atom to total non-metal atoms can still be maintained as 1:1 in these carbonitrides. Similarly substitutions of Ti with other metal atoms can also happen. For instance, Nb can partially or fully substitute for Ti forming (Ti,Nb)(C,N). Again the total metal to total non-metal atom ratio is maintained in these mixed carbonitrides as 1:1. This is a characteristic of the prominent mono-carbides and mono-nitrides, that is, total metal to total non-metal atom ration is 1:1, of Group IV (Ti, Zr, Hf) and Group V (V, Nb, Ta) elements. One exception is VC and VN, which are only partially soluble in each other. Carbon content in carbonitride (C,N) can be varied from about 0.01 to about 0.99, preferably from about 0.1 to about 0.9, and more preferably from about 0.3 to about 0.7 and abbreviated as (C,N).

The cermet compositions of the instant invention possess enhanced erosion and corrosion properties. The erosion rates were determined by the Hot Erosion and Attrition Test (HEAT) as described in the examples section of the disclosure. The erosion rate of the carbonitride cermets of the instant invention is less than $1.0\times10^{-6}$ cc/gram of SiC erodant. The corrosion rates were determined by thermogravimetric (TGA) analyses as described in the examples section of the disclosure. The corrosion rate of the carbonitride cermets of the instant invention is less than $1\times10^{-10}$ $g^2/cm^4\cdot s$.

The cermets of the instant invention possess fracture toughness of greater than about 3 $MPa\cdot m^{1/2}$, preferably greater than about 5 $MPa\cdot m^{1/2}$, and more preferably greater than about 10 $MPa\cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. (RS) phase of the cermet of the instant invention as described in the earlier paragraphs is primarily responsible for imparting this attribute.

Another aspect of the invention is the avoidance of embrittling inter-metallic precipitates such as sigma phase known to one of ordinary skill in the art of metallurgy. The carbonitride cermet of the instant invention has preferably less than about 5 vol % of such embrittling phases. The cermet of the instant invention with (PQ) and (RS) phases as described in the earlier paragraphs is responsible for imparting this attribute.

The cermet compositions are made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The resulting green body is then sintered at temperatures above about 1200° C. up to about 1750° C. for times ranging from about 10 minutes to about 4 hours. The sintering operation is preferably performed in an inert atmosphere or a reducing atmosphere or under vacuum. For example, the inert atmosphere can be argon and the reducing atmosphere can be hydrogen. Thereafter the sintered body is allowed to cool, typically to ambient conditions. The cermet prepared according to the process of the invention allows fabrication of bulk cermet materials exceeding 5 mm in thickness.

One feature of the cermets of the invention is their microstructural stability, even at elevated temperatures, making them particularly suitable for use in protecting metal surfaces against erosion at temperatures in the range of about 300° C. to about 850° C. It is believed this stability permits their use for time periods greater than 2 years, for example for about 2 years to about 10 years. In contrast many known cermets undergo transformations at elevated temperatures which results in the formation of phases which have a deleterious effect on the properties of the cermet.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, slide valve gates and guides catalyst regenerators, and the like. Thus, metal surfaces exposed to erosive or corrosive environments, especially at about 300° C. to about 850° C. are protected by providing the surface with a layer of the cermet compositions of the invention. The cermets of the instant invention can be affixed to metal surfaces by mechanical means or by welding.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analyses.

The following non-limiting examples are included to further illustrate the invention.

Example 1

70 vol % of 1.3 μm average diameter of $TiC_{0.7}N_{0.3}$ powder (from Japan New Metals Company) and 30 vol % of 6.7 μm average diameter 304 stainless steel (SS) powder (Osprey Metals, Fe(balance):18.5Cr:9.6Ni:1.4Mn:0.63Si, 95.9% screened below −16 μm) were dispersed with ethanol in HDPE milling jar. The powders in ethanol were mixed for 24 hours with Yttria Toughened Zirconia (YTZ) balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held at 400° C. for 30 min for residual solvent removal. The disc was then heated to 1500° C. at 15° C./min in argon and held at 1500° C. for 2 hours. The temperature was then reduced to below 100° C. at −15° C./min.

The resultant cermet comprised:

i) 69 vol % $TiC_{0.7}N_{0.3}$ with average grain size of about 1.5 μm
ii) 2 vol % secondary carbonitride $M_2(C,N)$ with average grain size of about 0.5 μm, where M=63Cr:24Fe:13Ti in wt %
iii) 29 vol % Cr-depleted alloy binder.

Figure 2:
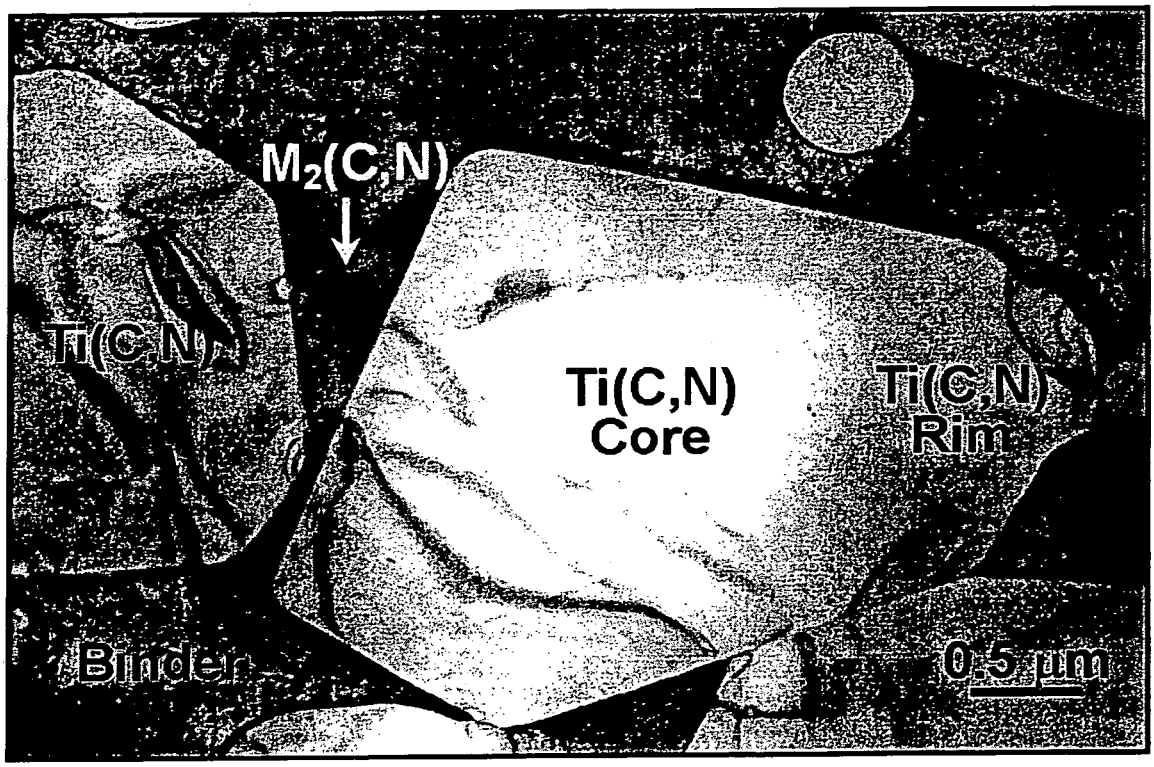
FIG. 2 is a transmission electron microscope (TEM) image of the same cermet shown in FIG. 1.

FIG. 1 is a SEM image of $TiC_{0.7}N_{0.3}$ cermet processed according to this example, wherein the bar represents 2 μm. In this image the $TiC_{0.7}N_{0.3}$ phase appears dark and the binder phase appears light. The Cr-rich secondary $M_2(C,N)$ phase is also shown in the binder phase. By M-rich, for instance Cr-rich, is meant the metal M is of a higher proportion than the other constituent metals comprising M. M(C,N) carbonitride where M is mainly Ti and Ta is formed as a rim around $TiC_{0.7}N_{0.3}$ core. Ta is believed to be an impurity from $TiC_{0.7}N_{0.3}$ powder. FIG. 2 is a TEM image of $TiC_{0.7}N_{0.3}$ cermet processed according to this example, wherein the bar represents 0.5 μm. In this image the $TiC_{0.7}N_{0.3}$ phase appears light and the binder phase appears dark. The Cr-rich secondary $M_2(C,N)$ phase is also shown in the binder phase. M(C,N) rim is formed around $TiC_{0.7}N_{0.3}$ core. The chemistry of binder phase is Cr-depleted due to the precipitation of Cr-rich secondary $M_2(C,N)$ phase and Ti-enriched-due to the dissolution of $TiC_{0.7}N_{0.3}$.

Example 2

75 vol % of 1.3 μm average diameter of $TiC_{0.3}N_{0.7}$ powder (from Japan New Metals Company) and 25 vol % of 6.7 μm average diameter Haynes® 566 alloy powder (Osprey Metals, Fe(balance):20.5Cr:20.3Ni:17.3Co:2.9Mo:2.5W:0.92Mn:0.45Si:0.47Ta, 96.2% screened below −16 μm) were used to process the cermet disc as described in Example 1. The cermet disc was then heated to 1500° C. at 15° C./min in argon and held at 1500° C. for 2 hours. The temperature was then reduced to below. 100° C. at −15° C./min.

The resultant cermet comprised:

i) 74 vol % $TiC_{0.3}N_{0.7}$ with average grain size of about 2 μm
ii) 2 vol % secondary carbonitride $M_2(C,N)$ with average grain size of about 0.5 μm, where M=65Cr:9Mo:12Ti:10Fe:3Co:1Ni in wt %
iii) 1 vol % secondary carbonitride $M_2(C,N)$ with average grain size of about 0.5 μm, where M=49Cr:30Mo:7Ti:10Fe:3Co:1Ni in wt %
iv) 23 vol % Cr-depleted alloy binder (36Fe:18Cr:22Ni:21Co:3Ti in wt %).

Figure 3:
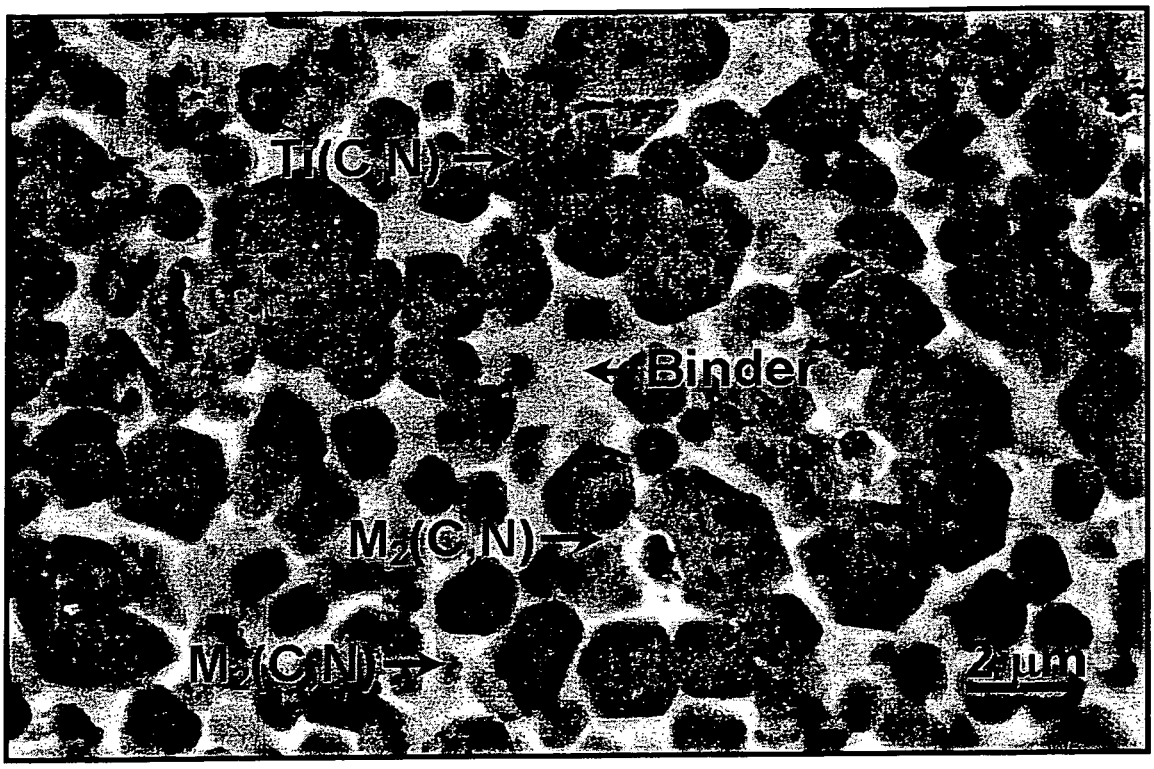
FIG. 3 is a SEM image of a $TiC_{0.3}N_{0.7}$ cermet made using 25 vol % Haynes® 556 alloy binder illustrating Ti(C,N) ceramic phase particles dispersed in binder and the reprecipitation of new phase $M_2$(C,N) where M is mainly Cr, Fe, and Ti and $M_2$(C,N) where M is mainly Mo, Nb, Cr, and Ti.
Figure 4:
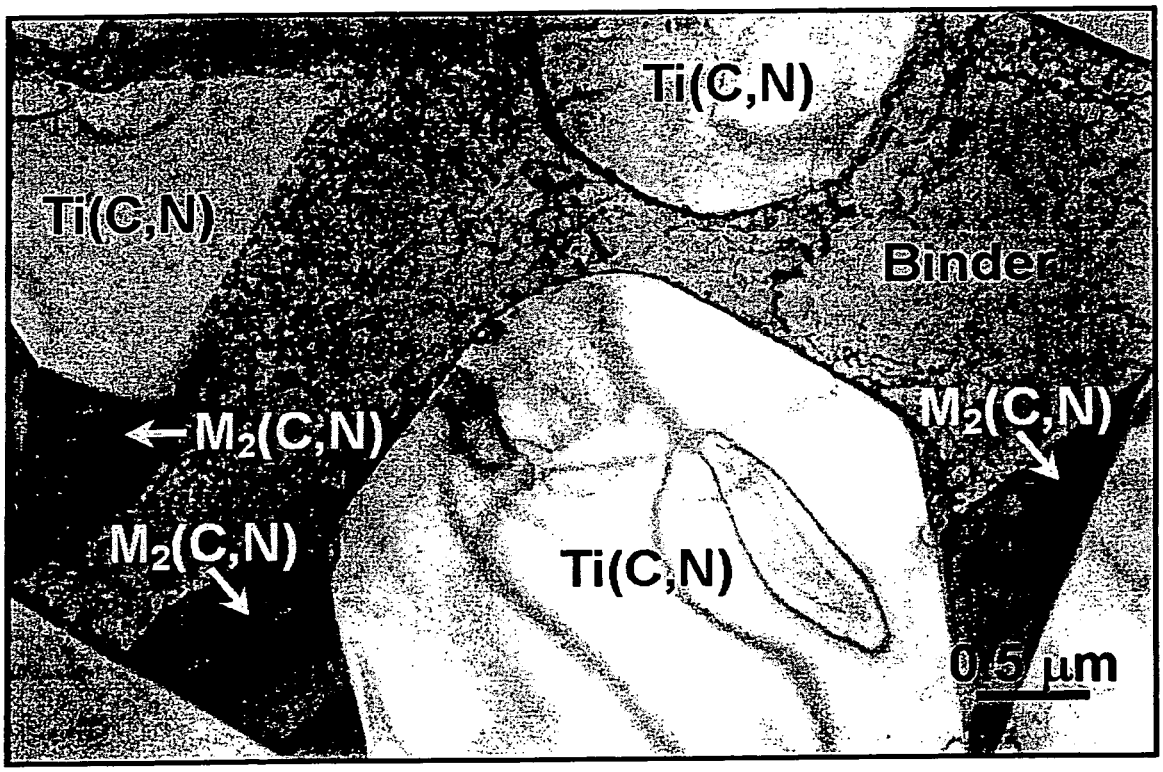
FIG. 4 is a transmission electron microscope (TEM) image of the same cermet shown in FIG. 3.

FIG. 3 is a SEM image of $TiC_{0.3}N_{0.7}$ cermet processed according to this example, wherein the bar represents 2 μm. In this image the $TiC_{0.7}N_{0.3}$ phase appears dark and the binder phase appears light. The Cr-rich secondary $M_2(C,N)$ phase and Mo-rich secondary $M_2(C,N)$ phase are also shown in the binder phase. FIG. 4 is a TEM image of $TiC_{0.3}N_{0.7}$ cermet processed according to this example, wherein the bar represents 0.5 μm. In this image the $TiC_{0.3}N_{0.7}$ phase appears light and the binder phase appears dark. The Cr-rich secondary $M_2(C,N)$ phase is also shown in the binder phase. Both Cr-rich secondary $M_2(C,N)$ and Mo-rich secondary $M_2(C,N)$ phases are also shown in the binder phase. The chemistry of binder phase is Cr-depleted and Ti-enriched.

Example 3

Figure 5:
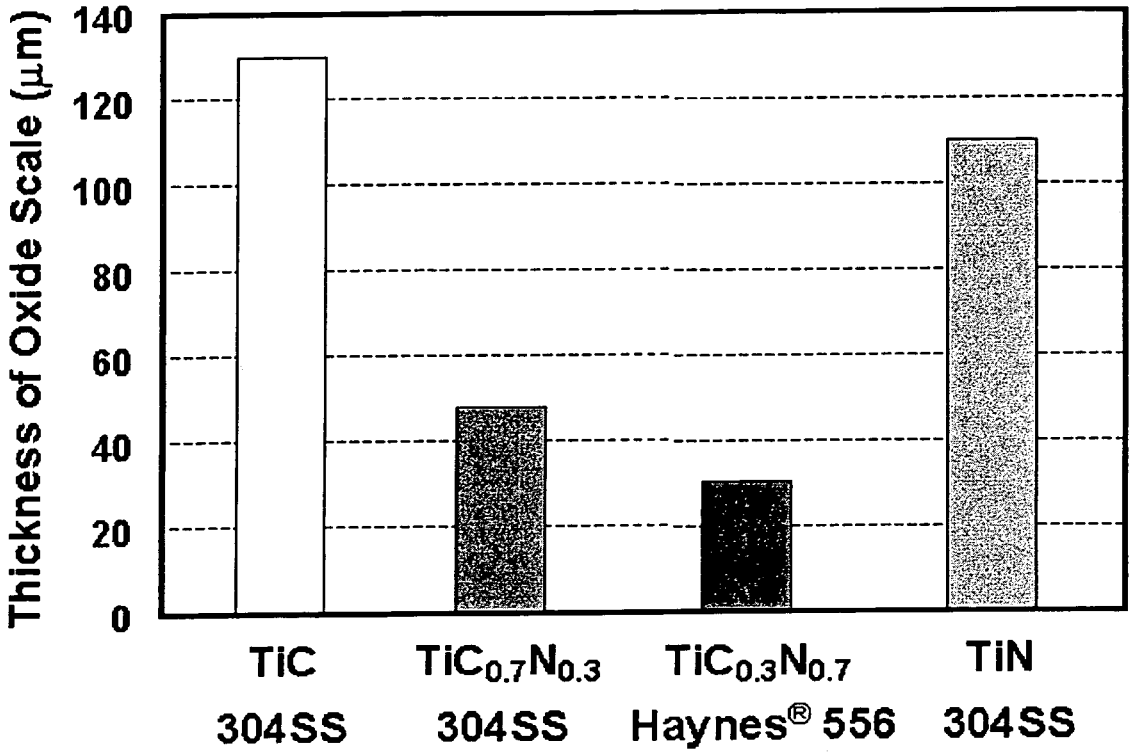
FIG. 5 is a graph showing the thickness (μm) of oxide layer as a measure of oxidation resistance of titanium carbonitride cermets of the instant invention made using 30 vol % binder exposed to air at 800° C. for 65 hours. The oxidation resistance of titanium carbide and nitride cermets are also shown for comparison.

Each of the cermets of Examples 1 and 2 was subjected to an oxidation test. The procedure employed was as follows:

1) A specimen cermet of about 10 mm square and about 1 mm thick was polished to 600 grit diamond finish and cleaned in acetone.
2) The specimen was then exposed to 100 cc/min air at 800° C. in thermo-gravimetric analyzer (TGA).
3) Step (2) was conducted for 65 hours at 800° C.
4) After 65 hours the specimen was allowed to cool to ambient temperature.
5) Thickness of oxide scale was determined by cross sectional microscopy examination of the corrosion.
6) In FIG. 5 any value less than 150 μm represents acceptable corrosion resistance.

The FIG. 5 showed that thickness of oxide scale formed on TiC, Ti(C,N) and TiN cermet surface. It is obvious that Ti(C,N) cermet has superior oxidation resistance than TiC or TiN cermet. For Ti(C,N) cermets, the thickness of oxide scale formed on cermet made using Haynes® 556 alloy binder is slightly lower than that made using 304 SS regardless of lower binder content. This improvement is caused by aliovalent elements present in Haynes® 556 alloy binder. The oxidation mechanism of TiC cermet is the growth of $TiO_2$, which is controlled by outward diffusion of interstitial $Ti^{+4}$ ions in $TiO_2$ crystal lattice. When oxidation starts, aliovalent elements, which are present in carbide or metal phases, dissolves substitutionally in $TiO_2$ crystal lattice since the cation size of aliovalent element (e.g., $Nb^{+5}$=0.070 nm) is comparable with that of $Ti^{+4}$ (0.068 nm). Since the substantially dissolved $Nb^{+5}$ ions increase the electron concentration of the $TiO_2$ crystal lattice, the concentration of interstitial $Ti^{+4}$ ions in $TiO_2$ decreases, thereby oxidation is suppressed. This example illustrates beneficial effect of aliovalent elements providing superior oxidation resistance.

Example 4

Each of the cermets of Examples 1 and 2 was subjected to a hot erosion and attrition test (HEAT). The procedure employed was as follows:

1) A specimen cermet disk of about 35 nm diameter and about 5 mm thick was weighed.
2) The center of one side of the disk was then subjected to 1200 g/min of SiC particles (220 grit, #1 Grade Black Silicon Carbide, UK abrasives, Northbrook, Ill.) entrained in heated air exiting from a tube with a 0.5 inch diameter ending at 1 inch from the target at an angle of 45°. The velocity of the SiC was 45.7 m/sec.
3) Step (2) was conducted for 7 hours at 732° C.
4) After 7 hours the specimen was allowed to cool to ambient temperature and weighed to determine the weight loss.
5) The erosion of a specimen of a commercially available castable refractory was determined and used as a Reference Standard. The Reference Standard erosion was given a value of 1 and the results for the cermet specimens are compared to the Reference Standard.

What is claimed is:

1. A method for protecting a metal surface subject to erosion at temperatures up to 1000° C., the method comprising providing the metal surface with a cermet composition according to the formula (PQ)(RS) comprising: a ceramic phase (PQ) and a binder phase (RS) wherein, P is a metal selected from the group consisting of Ti, Zr, Hf, V, Nb, Ta, Cr, Mo, W, Fe, Mn and mixtures thereof, Q is carbonitride, R comprises Fe and a metal selected from the group consisting of Ni, Co, Mn and mixtures thereof, S comprises Cr, at least one element selected from Al, Si and Y, and at least one aliovalent element selected from the group consisting of Ti, Zr, Hf, Ta, V, Nb, Mo, W, wherein the combined weights of said Cr, Al, Si, Y and mixtures thereof is at least 12 wt %, and the combined weights of said at least one aliovalent element is from 0.01 to 5 wt % based on the weight of the binder phase (RS), and wherein the ceramic phase (PQ) ranges from of about 50 to 95 vol % based on the volume of the cermet.

2. The method of claim 1 wherein said surface is subjected to erosion at temperatures in the range of 300° C. to 1000° C.

3. The method of claim 1 wherein said surface comprises the inner surface of a fluid-solids separation cyclone.

4. The method of claim 1 wherein the molar ratio of P:Q in the ceramic phase (PQ) can vary in the range of 1:3 to 3:1.

5. The method of claim 1 wherein said ceramic phase (PQ) is dispersed in the binder phase (RS) as spherical particles in the size range of 0.5 microns to 3000 microns diameter.

6. The method of claim 1 wherein the binder phase (RS) is in the range of 5 to 50 vol % based on the volume of the cermet and the mass ratio of R to S ranges from 50/50 to 90/10.

7. The method of claim 1 further comprising secondary carbonitrides (P'Q) wherein P' is selected from Ti, Zr, Hf, V, Nb, Ta, Cr, Mo, W, Fe, Ni, Co, Mn, Al, Si, Y and mixtures thereof.

8. The method of claim 1 having a fracture toughness of greater than about 3 MPa $m^{1/2}$.

9. The method of claim 1 having an erosion rate less than about $1\times10^{-6}$ cc/gram loss when subject to 1200 g/min of 10 μm to 100 μm SiC particles in air with impact velocity of at least about 45.7 m/sec (150 ft/sec) and at an impact angle of about 45 degrees and a temperature of at least about 732° C. (1350° F.) for at least 7 hours.

10. The method of claim 1 having corrosion rate less than about $1\times10^{-10}$ $g^2/cm^4\cdot s$ or an average oxide scale of less than 150 μm thickness when subject to 100 cc/min air at 800° C. for at least 65 hours.

11. The method of claim 1 having an erosion rate less than about $1\times10^{-6}$ cc/gram when subject to 1200 g/min of 10 μm to 100 μm SiC particles in air with an impact velocity of at least about 45.7 m/sec (150 ft/sec) and at an impact angle of about 45 degrees and a temperature of at least about 732° C. (1350° F.) for at least 7 hours and a corrosion rate less than about $1\times10^{-10}$ $g^2/cm^4\cdot s$ or an average oxide scale of less than 150 μm thickness when subject to 100 cc/min air at 800° C. for at least 65 hours.

12. The method of claim 1 having embrittling phases less than about 5 vol % based on the volume of the cermet.

13. A method for protecting a metal surface subject to erosion at temperatures up to 1000° C., the method comprising providing the metal surface with a bulk cermet material according to the formula (PQ)(RS) comprising: a ceramic phase (PQ) and a binder phase (RS) wherein, P is a metal selected from the group consisting of Ti, Zr, Hf, V, Nb, Ta, Cr, Mo, W, Fe, Mn and mixtures thereof, Q is carbonitride, R comprises Fe and a metal selected from the group consisting of Ni, Co, Mn and mixtures thereof, S comprises Cr, at least one element selected from Al, Si and Y, and at least one aliovalent element selected from the group consisting of Ti, Zr, Hf, Ta, V, Nb, Mo, W, wherein the combined weights of said Cr, Al, Si, Y and mixtures thereof is at least 12 wt %, and the combined weights of said at least one aliovalent element is from 0.01 to 5 wt % based on the weight of the binder phase (RS), and wherein the overall thickness of the bulk cermet material is greater than 5 millimeters.

14. The method of claim 13 wherein said surface is subjected to erosion at temperatures in the range of 300° C. to 1000° C.

15. The method of claim 13 wherein said surface comprises the inner surface of a fluid-solids separation cyclone.

16. The method of claim 13 wherein the ceramic phase (PQ) ranges from of about 50 to 95 vol % based on the volume of the cermet.

17. The method of claim 16 wherein the molar ratio of P:Q in the ceramic phase (PQ) can vary in the range of 1:3 to 3:1.

18. The method of claim 13 wherein said ceramic phase (PQ) is dispersed in the binder phase (RS) as spherical particles in the size range of 0.5 microns to 3000 microns diameter.

19. The method of claim 13 wherein the binder phase (RS) is in the range of 5 to 50 vol % based on the volume of the cermet and the mass ratio of R to S ranges from 50/50 to 90/10.

20. The method of claim 13 further comprising secondary carbonitrides (P'Q) wherein P' is selected from Ti, Zr, Hf, V, Nb, Ta, Cr, Mo, W, Fe, Ni, Co, Mn, Al, Si, Y and mixtures thereof.

21. The method of claim 13 having a fracture toughness of greater than about 3 MPa $m^{1/2}$.

22. The method of claim 13 having an erosion rate less than about $1\times10^{-6}$ cc/gram loss when subject to 1200 g/min of 10 μm to 100 μm SiC particles in air with impact velocity of at least about 45.7 m/sec (150 ft/sec) and at an impact angle of about 45 degrees and a temperature of at least about 732° C. (1350° F.) for at least 7 hours.

23. The method of claim 13 having corrosion rate less than about $1\times10^{-10}$ $g^2/cm^4\cdot s$ or an average oxide scale of less than 150 μm thickness when subject to 100 cc/min air at 800° C. for at least 65 hours.

24. The method of claim 13 having an erosion rate less than about $1\times10^{-6}$ cc/gram when subject to 1200 g/min of 10 μm to 100 μm SiC particles in air with an impact velocity of at least about 45.7 m/sec (150 ft/sec) and at an impact angle of about 45 degrees and a temperature of at least about 732° C. (1350° F.) for at least 7 hours and a corrosion rate less than about $1\times10^{-10}$ $g^2/cm^4\cdot s$ or an average oxide scale of less than 150 μm thickness when subject to 100 cc/min air at 800° C. for at least 65 hours.

25. The method of claim 13 having embrittling phases less than about 5 vol % based on the volume of the cermet.

* * * * *